United States Patent [19]

Bruno

[11] 4,002,222

[45] Jan. 11, 1977

[54] COMBINATION SCAFFOLD AND UTILITY PLATFORM

[76] Inventor: Edward G. Bruno, 141-18 250th St., Rosedale, N.Y. 11422

[22] Filed: Feb. 27, 1976

[21] Appl. No.: 661,974

[52] U.S. Cl. ..... 182/132; 182/82; 182/113; 182/145

[51] Int. Cl.[2] ..... E04G 1/15

[58] Field of Search ..... 182/132, 131, 130, 145, 182/146, 82, 222, 113; 248/235

[56] References Cited

UNITED STATES PATENTS

| | | | |
|---|---|---|---|
| 979,220 | 12/1910 | Taber | 182/132 |
| 3,169,604 | 2/1965 | Pranger | 182/132 |
| 3,198,470 | 8/1965 | Owens | 182/82 |
| 3,679,026 | 7/1972 | Hausen | 182/132 |

*Primary Examiner*—Reinaldo P. Machado
*Attorney, Agent, or Firm*—Bauer, Amer & King

[57] ABSTRACT

The present invention provides a combination scaffold and utility platform that is adapted to be used with two, at least, spaced apart support members. There is provided a first platform that is positioned on the support members in a spanning relationship therewith. The first platform includes therein a plurality of transverse openings that are spaced apart along the length dimension thereof and in a common plane. A second elongated platform is positioned in a plane above and alongside the first platform. The two platforms are coupled to each other by means of rods, each of which has a first portion that is adapted to be removably inserted in one of the openings in the first platform and a second portion that is spaced above and alongside the openings in the first platform in order to support the second platform. The rods that support the second platform with respect to the first platform are also provided with means for preventing the tilting of the second platform with respect to the first platform.

The aforementioned abstract is neither intended to define the invention of the application which, of course, is measured by the claims, nor is it intended to be limiting as to the scope of the invention in any way.

10 Claims, 8 Drawing Figures

10
12
14
16
16a
16b
16c
18
20
21
22
24
26
28
30
32
34
36
38
40
42
46
48
50
52
62
64
66
68
70
72
74
76
78
80
96
98
100
102
W
P
T

COMBINATION SCAFFOLD AND UTILITY PLATFORM

BACKGROUND OF THE INVENTION

1. Field of the Invention

This invention relates, generally, to scaffolding means and, more particularly, to low cost, readily assemblable and disassemblable scaffold means that may be stored compactly in the disassembled condition.

2. Description of the Prior Art

There are many diverse industrial applications for scaffold means of the type to which the present invention is directed. The scaffolding may be used internally or externally for the repair and maintenance of buildings. For example, scaffolding of the type to which the present invention is directed may be used by painters, paper hangers, electrical and plumbing contractors or the like. A particular application of a scaffold, of the type to which the present invention is directed, is in the installation of siding such as aluminum siding wherein it is desirable, and in fact is frequently necessary, to have a relatively large store of tools and supplies close at hand during the installation of the siding.

While the need for structure such as exemplified by the present invention has long been known, and while there are many examples of prior art scaffolds in the patent literature, it will be appreciated from the subsequent descriptions of the present invention that the prior art does not satisfy all of the requirements of those working in the field. Prior art structure is either bulky or costly or both and, more frequently than not, is difficult and costly to assemble. Where the prior art does provide adequately sized auxiliary platform means, such as will be described in connection with the present invention, it does so at the expense of being relatively difficult to store when in the disassembled condition.

One example typical of prior art structure is disclosed in U.S. Pat. No. 3,438,460 granted on Apr. 15, 1969, to L. J. Solari. In the Solari patent there is disclosed a pair of upright standards on which an elongated, horizontally disposed workman's supporting section is adapted to be positioned. The upright standards include an elevatable section mounted thereon for movement therealong from which the corresponding end of the workman's supporting platform may be supported. The base section of each standard is horizontally elongated and includes upwardly convergent opposite end portions that are interconnected at their upper ends by means of a horizontal portion. It will be appreciated from a thorough reading of the Solari patent that the structure disclosed therein is unnecessarily complex, is unnecessarily bulky, is unnecessarily costly, and is particularly unwieldy, thereby precluding the possibility of compact storage when not in use.

Another example of prior art scaffolding is disclosed in U.S. Pat. No. 3,392,801 granted on July 16, 1968, to K. W. Gethmann. In the Gethmann patent there is disclosed a scaffold device in which a first section has opposite upright ends and brace means extending from one upright end to the other upright end. A pair of vertically disposed hollow tubular members are positioned on the upper portion of the upright ends in order to support a second scaffold section that is comprised of two tie braces and two scaffold members, all four of which are further comprised of a horizontal member connecting two vertically disposed tubular members.

The tubular members of the scaffold members are detachably secured to the upright ends of the first scaffold section and the tubular members of the tie braces slidably engage the tubular members of the two scaffold members, thereby interconnecting them. While the Gethmann patent does represent some improvement over the Solari structure in that it is more readily disassemblable, it will be appreciated that means are not provided for permitting a wide range of positions and locations of the second scaffold section.

Still another form of scaffold is disclosed in U.S. Pat. No. 835,059 granted on Nov. 6, 1906, to G. Curley. In the Curley patent there are disclosed a plurality of upright portions having horizontal tie members extending between the two side sections thereof. Platforms are adapted to be positioned on the tie members are various heights depending upon the height of the tie members above the ground. From the disclosure of the Curley patent it will be evident that the structure is extremely complex, is costly and is time consuming to assemble. In addition, the structure disclosed in the Curley patent does not readily lend itself to compact storage when not in use.

SUMMARY OF THE INVENTION

In its broadest aspect, the present invention provides a combination scaffold and utility platform therefor, which combination of structure is adapted for use with at least two spaced apart support members such as vertical posts having support arms slidably mounted for vertical movement thereon in order to support a first platform. A second platform is positioned by suitable coupling means in a plane above and alongside the first platform. The coupling means may take the form of a plurality of brackets each having a first rod that is adapted to be removably positioned in one of a plurality of transverse holes formed in the first platform. Each bracket includes a vertical riser section that extends upwardly from the plane of the first rod and terminates in a second rod that is in spaced, parallel relationship with respect to the plane of the first rod whereby the second platform may be placed on the plurality of second rods. In addition, means are provided for preventing the tilting of the bracket with respect to the first and second platforms by means of pairs of third rods that are associated with each of the first rods. The third rods are arranged, in one embodiment of the invention to overlay the top surface of the first platform and, in a second embodiment of this invention, are arranged to engage a second plurality of transverse holes that are formed in the first platform.

Accordingly, it is an object of the present invention to provide an improved scaffold and platform assembly.

Another object of the present invention is to provide an improved combination scaffold and platform assembly that may be readily assembled and disassembled.

Still another object of the present invention is to provide an improved scaffold and platform assembly that is relatively low in cost to manufacture.

A further object of the present invention is to provide an improved scaffold and platform assembly that is relatively compact when disassembled and stored.

These and other objects, features and advantages of the invention will, in part, be pointed out with particularity, and will, in part, become obvious from the following more detailed description of the invention, taken in conjunction with the accompanying drawing, which form an integral part thereof.

DESCRIPTION OF THE DRAWING

In the various figures of the drawing, like reference characters designate like parts.

In the drawings.

DESCRIPTION OF THE PREFERRED EMBODIMENT

Figures 1, 2, 3, 4:
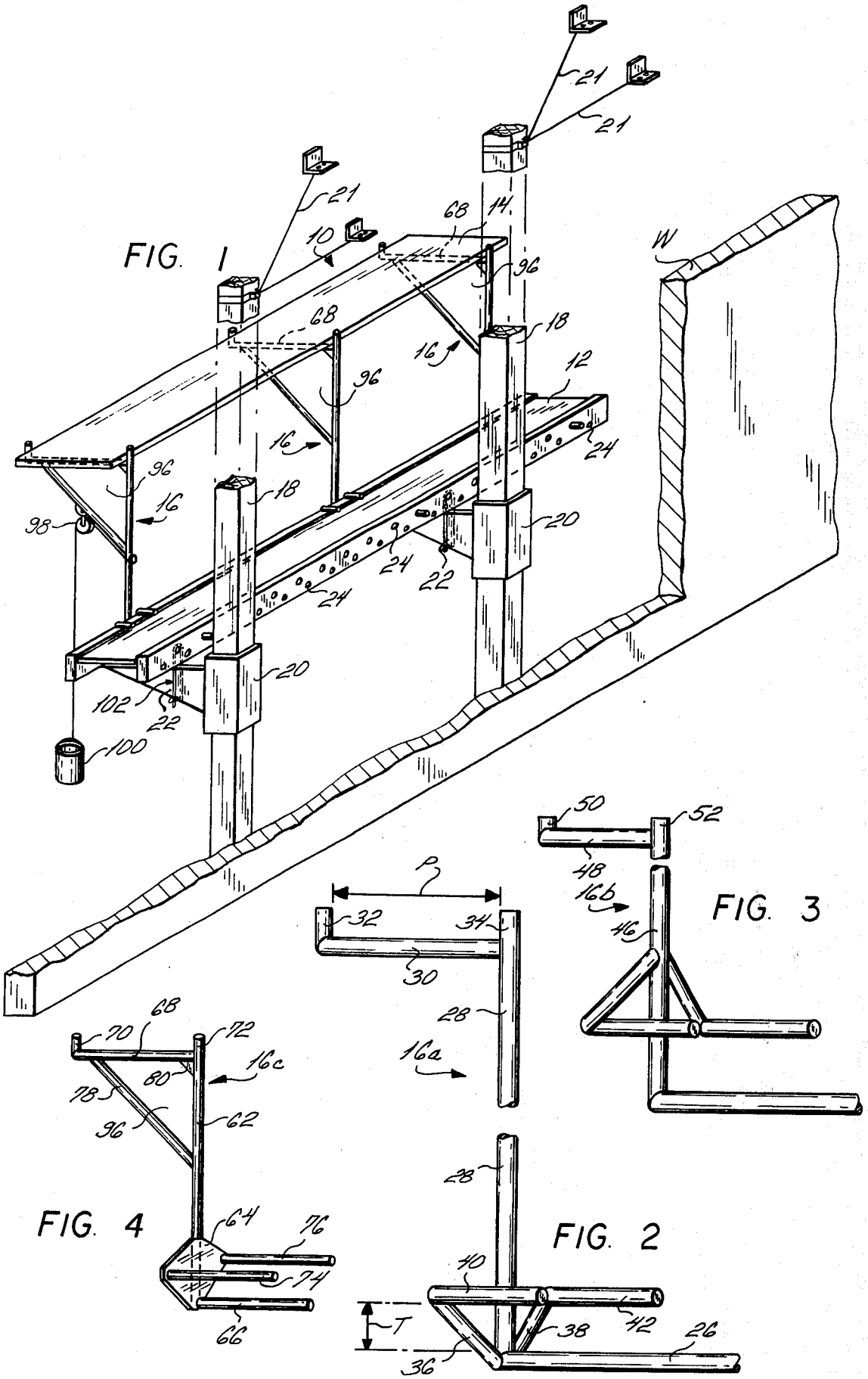
FIG. 1 is a schematic, perspective view illustrating the basic concept of the present invention.
FIG. 2 is a perspective view illustrating one embodiment of the coupling means comprising the present invention.
FIG. 3 is a fragmentary perspective view illustrating an alternative embodiment of the present invention.
FIG. 4 is a perspective view illustrating still another alternative embodiment of the coupling means comprising the present invention.

FIG. 1 illustrates a readily assemblable and dissassemblable scaffold and platform assembly 10 comprising one embodiment of the present invention. The assembly 10 comprises first platform means 12, second platform means 14 and a plurality of brackets generally designated by the reference character 16 which serve to couple and space apart the first and second platform means 12 and 14, respectively. As shown in FIG. 1, the first platform means 12 is supported by a pair of posts 18 each of which has a sleeve 20 thereon that is arranged for vertical sliding movement relative to the post 18. An arm 22 is secured integrally, in any suitable manner, with each sleeve 20 and extends outwardly therefrom in order to support the platform means 12. It should be noted at this time that the posts 18, together with the sleeves 20 and the arms 22, are illustrated for purposes of explanation only and do not form part of the present invention. A pair of spaced apart ladders may be substituted for the posts. Any other conventional means well known in the art may be used for supporting the first platform means 12. It should be further noted that in a conventional and well known manner the posts 18 or their equivalent structure are preferably secured to a wall W of the building on which the work is to be done for purposes of safety and for purposes of rigidity.

The first platform means 12 may be made of any suitable material that is, preferably, light in weight and rigid. With suitable stiffening means an aluminum alloy may be employed. Alternatively, the first platform means may be of any suitable resinous material or may be made with a honeycomb interior and an enclosing sheath thereabout. Regardless of the material used for the first platform means 12, a plurality of transverse holes 24 are formed therein with the holes 24 being spaced apart, preferably equally, in the longitudinal direction. Similarly, the second platform means 14 may also be formed of any of the aforementioned materials but, as shown in FIG. 1, transverse holes are not formed therein.

As mentioned hereinbefore, a plurality of bracket means 16 are used for positioning the second platform means 14 in a plane that is above and alongside the first platform means 12. FIGS. 2, 3 and 4 illustrate three different forms of coupling means. In the FIG. 2 embodiment, the coupling means 16*a*is comprised of a plurality of rod-like or tubular portions the first of which is designated by the reference character 26 and is adapted to be received in one of the transverse holes 24 in the first platform means 12. A riser section 28 is suitably secured to the first rod section 26 such as by welding or the like and extends vertically upward therefrom. A second rod 30 is secured proximate the upper end of the riser section 28, such as by welding or the like and is provided with an outer stop 32 and an inner stop 34 that is formed from the uppermost end portion of the riser section 28. The dimension P between the outer and inner stops 32 and 34, respectively, is the same or is slightly greater than the width dimension of the upper platform 14 which is received therebetween so as to rest on the upper second rod 30. Proximate the lower end of the riser section 28 there are provided a first pair of angularly oriented arms 36 and 38, which are secured thereto such as by welding or the like. A pair of third rods 40 and 42 extend outwardly from the upper ends of the arms 36 and 38, respectively, and are positioned spaced from but in a plane that is substantially parallel to the plane of the first rod 26 by a dimension T which corresponds to or is slightly greater than the thickness of the first platform means 12. It will be appreciated that the first platform means 12 is adapted to be removably positioned between the first rod 26 and the pair of third rods 40 and 42.

In FIG. 3 there is shown an alternative embodiment of the coupling means 16 shown in FIG. 1. In the FIG. 3 embodiment, the coupling means 16*b* may be made from the same material as that of the coupling means 16*a* shown in FIG. 2 and is comprised of a first rod 44 that is adapted to be received in any one of the plurality of transverse openings 24 formed in the first platform means 12. A riser section 46 extends upwardly from the first rod 44 and has secured thereto a second rod 48 that is positioned proximate the upper end thereof. The second rod 48 extends outwardly from the riser section 46 in the opposite direction from the first rod 44, but in a plane substantially parallel thereto and is provided with outer and inner stops 50 and 52. The outer stops 50 may be secured to the second rod 48 by any suitable means such as welding or the like while the inner stop 52 may be defined by the upper end of the riser section 46. Proximate the lower end of the riser section 46 there are provided a pair of angularly oriented arms 54 and 56 from which extend a pair of third rods 58 and 60, respectively. The pair of third rods 58 and 60 are located in a plane that is substantially parallel to and spaced from the plane of the first rod 44 by a dimension that is substantially equal to or slightly greater than the thickness of the first platform means 12. Similarly, the spacing between the outer and inner stops 50 and 52, respectively, is aproximately equal to or is slightly greater than the width dimension of the second platform means 14.

A third embodiment of the coupling means 16 is shown in FIG. 4 and is designated generally by the reference character 16*c*. The coupling means 16*c* is comprised of a riser section 62 that has secured thereto, such as by welding or the like, a plate 64. A first rod 66 is secured such as by welding or the like to the plate 64. A second rod 68 is secured proximate the upper end of the riser section 62, such as by welding or the like, and is provided with outer and inner stops 70 and 72. The inner stops 72 may be defined by the upper end of the riser section 62. As in the previous embodiments, the space between the outer and inner stops 70 and 72, respectively, is approximately the same or is slightly greater than the width dimension of the second platform means 14. Also secured to the plate 64 are a pair of third rods 74 and 76 which are in a common plane that is spaced above and is parallel to the plane of the first rod 66. The dimension between the plane of the third rods 74 and 76 and that of the first rod 66 is approximately equal to or is slightly greater than the thickness of the first platform means 12. The coupling means 16*c* is also provided with rigidizing means in the form of an angularly oriented rod 78 that is secured to the second rod 68 and to the riser section 62 such as by welding or the like as well as a gusset 80 that is secured to the junction of the second rod 68 and the riser section 62 such as by welding or the like. It will be evident that the angularly oriented rod 78 and the gusset 80 may also be applied to the first and second embodiments of the coupling means 16 shown in FIGS. 2 and 3, respectively.

Figure 5:
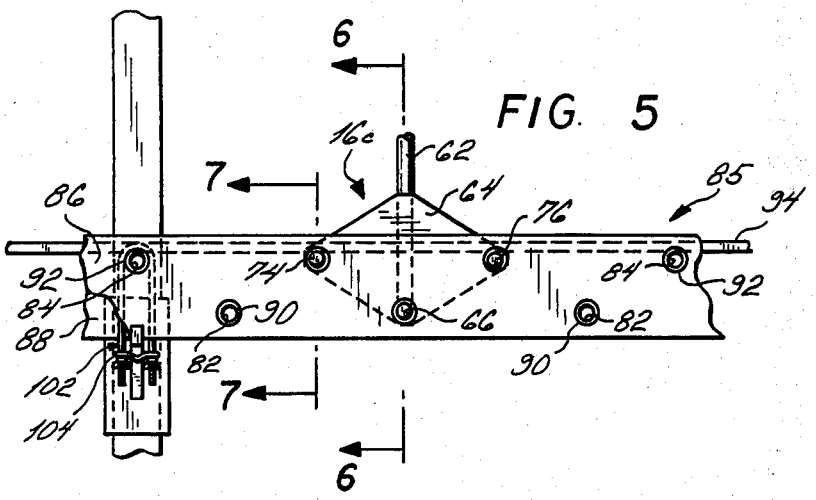
FIG. 5 is a fragmentary side elevational view illustrating an alternative embodiment of the first platform comprising the present invention.

Whereas, in the first embodiment of the invention described hereinabove, the first rod of each coupling means 16 was received in an opening 24 with the pair of third rods overlaying the top surface of the platform means 12 in order to prevent tilting of the second platform means 14 with respect to the first platform means 12, an alternative embodiment of the present invention shown in FIG. 5, contemplates the use of both a first plurality of transverse openings 82 for receiving the first rods of the coupling means 16 and a second plurality of openings 84 for receiving the pair of third rods of each of the coupling means 16. As shown in FIG. 5, the first plurality of openings 82 are in a first, common plane while a second plurality of openings 84 are in a second, common plane with the vertical dimension between the first and second plurality of openings 82 and 84, respectively, coinciding with the dimension between the axes of the first rod of each of the coupling means 16 and the pair of third rods of each of a coupling means 16.

Figure 7:
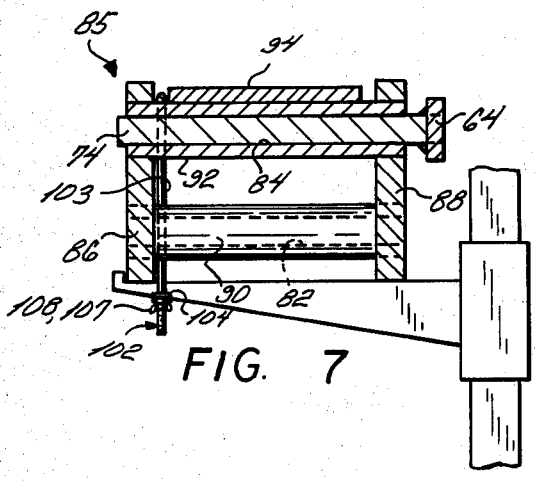
FIG. 7 is another transverse sectional elevational view taken along line 7—7 of FIG. 5.
Figure 6:
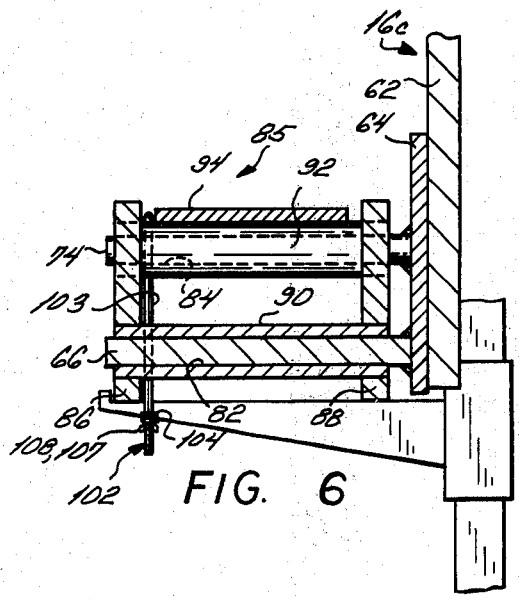
FIG. 6 is a transverse sectional elevation view taken along line 6—6 of FIG. 5.
Figure 8:
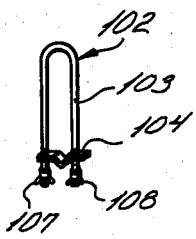
FIG. 8 is an end elevational view showing a clamp securing the scaffold rung to a pump jack bracket.

FIGS. 6 and 7 illustrate an alternative form that may be utilized for the first platform means shown in FIG. 5. The first platform means 85 in the embodiment of FIGS. 6 and 7 is comprised of a pair of spaced apart parallel rails 86 and 88 which are secured to each other by means of a plurality of lower and upper tubes 90 and 92 which are secured thereto such as by welding or the like. The tubes 90 and 92 define the first and second plurality of openings 82 and 84, respectively. The upper tubes 92 are utilized for supporting a removable, lightweight plank 94.

It will be evident particularly from FIG. 1 that, when assembled, the second platform means 12 is spaced in a plane that is above and alongside the first platform means 14 so as to define a flat, relatively large area for storing material that is used during a construction operation. Moreover, since a plurality of selectively positionable coupling means 16 are used, elongated pieces of material may also be stored by positioning the material through the aligned openings 96 that are formed between the riser section 62, the second rod 68 and the stiffening rod 78 such as shown, for example, in the FIG. 4 embodiment of the coupling means 16*c*. By means of a pulley arrangement 98, such as illustrated in FIG. 1, a bucket 100 can be used for raising and lowering supplies.

In FIGS. 5 and 7 there is shown a clamp 102 consisting of a U-Bolt 103 and a clamping section 104 with mating wingnuts 107, 108. The lower section clamps blade 22 of the jack while the upper section 104 clamps across tube 90 to prevent the scaffold from tilting under the load on the second platform 14. It should be noted that the platform 14 is shown with a plank 15 covering it. However, it may be omitted as the siding being used for construction is laid directly on cross arms 68 to serve as plank 15. Uprights 18 are usually secured to the building being worked on by braces 21 nailed to the roof (not shown).

It will also be evident from the foregoing description that the scaffold and platform assembly described hereinabove is both readily assemblable and disassemblable and, when in the assembled condition, the structure is rigid and safe for normal operations. In the disassembled condition it will be evident that the present invention requires a minimum of storage space. By virtue of the construction described hereinabove, it will also be apparent that the present invention is relatively low in cost and can be readily manipulated, stored and handled.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A combination scaffold and platform assembly for use with at least two spaced apart support members, said assembly comprising:

a. first elongated platform means adapted to be removably positioned on the support members in spanning relationship therewith, said first platform means including a first plurality of transverse openings therein, said first plurality of openings being spaced apart along the length dimension of said first platform means in a first common plane;

b. a plurality of coupling means having a portion thereof for removably engaging said openings in said first platform means; and c. second elongated platform means positioned on said coupling means in a plane that is above and alongside said first platform means.

2. The assembly according to claim 1 wherein said coupling means each comprises a first rod adapted to be positioned in one of said plurality openings, a riser section extending upwardly from said first rod, a second rod integral with said riser section and positioned in spaced parallel relationship with respect to said first rod whereby said second platform means may be placed on said second rods and means for preventing tilting of said coupling means.

3. The combination according to claim 1 wherein said first platform means comprises a pair of spacedly parallel elongated rails and said first plurality of transverse openings are defined by a plurality of tubes extending transversely between said rails for receiving said first rods of each said coupling means.

4. The combination according to claim 2 wherein said first platform means further comprises an elongated plank positioned on said tubes intermediate said rails.

5. The combination according to claim 4 wherein said plank is removable.

6. The combination according to claim 2 wherein said means for preventing tilting of said coupling means comprises a pair of third rods that are longitudinally spaced apart with respect to the length dimension of said first platform means and which are spaced in a vertical direction from said first rod by a dimension that is at least as great as the thickness of said first platform means, said pair of third rods being arranged to engage a portion of said first platform means when said first rod is positioned in one of said plurality of openings in said first platform means.

7. The combination according to claim 6 wherein there are a second plurality of transverse openings in said first platform means, said second plurality of openings being spaced apart along the length dimension of said first platform means in a second, common plane that is substantially parallel to said first common plane of said first plurality of openings for receiving said third pair of rods of said means to thereby prevent tilting of said coupling means.

8. The combination according to claim 6 wherein said pair of third rods comprise a pair of first sections secured to said riser section at the juncture thereof with said first rod and a pair of second sections secured to said first sections in spaced parallel relationship with said first rod.

9. The combination according to claim 6 wherein said pair of third rods comprise a pair of first sections secured to said riser section and extending downwardly at an angle with respect to the longitudinal axis thereof and a pair of second sections secured to said first sections in spaced parallel relationship with said first rods.

10. The combination according to claim 6 wherein a plate is secured to and proximate the lower end of said riser section with said first rod and said pair of third rods being secured to said plate.

* * * * *